US009655385B2

(12) United States Patent
Marino

(10) Patent No.: US 9,655,385 B2
(45) Date of Patent: May 23, 2017

(54) REVERSIBLE SLING SHIRT

(71) Applicant: RAM Group, Inc., Milwaukee, WI (US)

(72) Inventor: Rick A. Marino, Milwaukee, WI (US)

(73) Assignee: RAM Group, Inc., Milwaukee, WI (US)

( * ) Notice: Subject to any disclaimer, the term of this patent is extended or adjusted under 35 U.S.C. 154(b) by 0 days.

(21) Appl. No.: 14/717,695

(22) Filed: May 20, 2015

(65) Prior Publication Data

US 2015/0335077 A1 Nov. 26, 2015

Related U.S. Application Data

(63) Continuation of application No. 29/491,488, filed on May 21, 2014.

(51) Int. Cl.

| | |
|---|---|
| ***A41B 1/08*** | (2006.01) |
| ***A41B 1/10*** | (2006.01) |
| ***A41D 13/12*** | (2006.01) |

(52) U.S. Cl.

CPC ..... *A41B 1/08* (2013.01); *A41B 1/10* (2013.01); *A41D 13/129* (2013.01); *A41D 13/1245* (2013.01)

(58) Field of Classification Search

CPC ..... A41D 1/18; A41D 11/00; A41D 13/1245; A41D 13/1236; A41D 27/10; A41D 13/129; A41D 1/02; A41D 1/04; A41B 1/00; A41B 1/08; A41B 9/06; A41B 1/10

USPC ..... 2/114, 75, 80, 83, 70, 125; D2/717, 720, D2/774, 840, 858

See application file for complete search history.

(56) References Cited

U.S. PATENT DOCUMENTS

| | | | | | |
|---|---|---|---|---|---|
| 2,305,406 | A | * | 12/1942 | Clyne | A41D 27/10 2/115 |
| 2,389,298 | A | * | 11/1945 | Ellis | A41F 1/002 101/389.1 |
| 2,475,058 | A | * | 7/1949 | Sheard | A41D 13/1236 2/114 |
| 2,504,534 | A | * | 4/1950 | Kephart | A41D 10/00 2/114 |
| 3,654,632 | A | * | 4/1972 | Lacroix | A41D 27/10 2/125 |
| 4,258,440 | A | * | 3/1981 | McGowan | A41D 13/1236 2/114 |
| 4,473,908 | A | * | 10/1984 | Knecht | A41B 1/00 2/114 |
| 5,603,123 | A | * | 2/1997 | Chupa | A41D 13/1236 2/114 |
| 5,611,087 | A | * | 3/1997 | Adkins | A41D 13/1236 2/114 |

(Continued)

*Primary Examiner* — Amy Vanatta
(74) *Attorney, Agent, or Firm* — Boyle Fredrickson, S.C.

(57) ABSTRACT

A reversible sling shirt may allow a patient to put on a shirt while keeping an injured shoulder with the arm bent at a prescribed, therapeutic angle. The reversible sling shirt may include a removable seam along a body of the shirt and at least a bottom portion of a sleeve. A plurality of magnetic fasteners may be sewn along the removable seam within individual plastic pockets, thus allowing a patient to put on the reversible sling shirt and take it off while keeping the injured arm bent at the predetermined angle. The reversible sling shirt may also be put on and taken off all while the injured arm remains in traction, suspended by a sling.

17 Claims, 10 Drawing Sheets

(56) References Cited

U.S. PATENT DOCUMENTS

| | | | | | |
|---|---|---|---|---|---|
| D381,488 | S | * | 7/1997 | Small | D2/718 |
| 5,890,231 | A | * | 4/1999 | Ueda | A41D 1/08 2/125 |
| 5,991,923 | A | * | 11/1999 | Maria | A41D 13/1236 2/114 |
| 6,216,271 | B1 | * | 4/2001 | Chen | A41D 13/1245 2/114 |
| 6,282,718 | B1 | * | 9/2001 | Drakford | A41D 13/0015 2/115 |
| D512,550 | S | * | 12/2005 | Dureus | D2/737 |
| D665,151 | S | * | 8/2012 | Wahl | D2/717 |
| D698,122 | S | * | 1/2014 | Wahl | D2/840 |
| D736,498 | S | * | 8/2015 | Yadrich | D2/840 |
| 2002/0178551 | A1 | * | 12/2002 | Hsu | A41F 1/002 24/303 |
| 2012/0246796 | A1 | * | 10/2012 | Dunn | A41D 13/1245 2/114 |
| 2014/0130228 | A1 | | 5/2014 | Horton | |
| 2014/0130231 | A1 | | 5/2014 | Horton | |
| 2014/0130233 | A1 | | 5/2014 | Horton | |
| 2014/0143985 | A1 | | 5/2014 | Horton | |
| 2015/0033439 | A1 | * | 2/2015 | Dimotsantos | A41D 13/1236 2/114 |

* cited by examiner

REVERSIBLE SLING SHIRT

CROSS-REFERENCE TO RELATED APPLICATION

This application claims a benefit of priority and is a continuation in part of U.S. patent application Ser. No. 29/491,488 filed on May 21, 2014, the entire contents of which are hereby expressly incorporated by reference into the present application.

BACKGROUND OF THE INVENTION

1. Field of the Invention

This invention is related to the field of garments for individuals with injured shoulders or other related injuries that require an arm to be immobilize, for example, in a sling.

2. Discussion of the Related Art

Arm and shoulder injuries are commonly treated with a combination of traction and immobilization. This minimizes external stresses on the musculoskeletal system and allows both hard and soft tissues to repair. One common problem with traction and immobilization of a person's arm is that it is very difficult, if not impossible, to put on clothing while keeping the injured arm in traction.

Patients frequently strain themselves and experience pain and discomfort moving injured arms into shirts and through sleeves. One solution to this problem is hospital garments that have an open back. Including an open back on a shirt offers greater flexibility when getting dressed, but the end result falls short of fully achieving the main objective, i.e., covering up oneself. Wearing a shirt with an open back may be acceptable in a private room, but oftentimes patients are required to walk around a healthcare facility.

Patients also experience discomfort and strain injuries when removing slings to dress themselves or while being assisted with putting on a shirt. The process of removing the sling and then putting it back on requires the patient to use their injured arm when it should remain immobilized. This is currently considered an acceptable strain on arm recovery as patients need to change clothing.

What is therefore needed is a garment that minimizes pain and discomfort when a patient with an injured arm is getting dressed. What is also needed is a shirt that allows an injured arm to remain in traction and immobilized while getting dressed. What is also needed is a shirt that allows an injured arm to remain in traction with a sling while the shirt is being put on and removed. An additional need is for a shirt that may be easily opened and closed. A further requirement is for the shirt to be open and closed with little effort such that the patient may complete the task without assistance. Lastly, what is needed is a shirt that does not visually stand out from an ordinary shirt so as to minimize any self-conscious concerns by the patient.

SUMMARY AND OBJECTS OF THE INVENTION

An inventive reversible sling shirt for a patient with an injured arm or shoulder may include a body having a first and second shoulder and a waist area. A sleeve and a seamed sleeve preferably extend from the first and second shoulder, respectively. A continuous removable seam extending along the seamed sleeve and extending along the body to the waist area allows the shirt to open along the removable seam. A plurality of fasteners along the removable seam is configured to join one another and release from one another.

An open neck between the first and second shoulder may be configured to remain a solid and continuous circumference. The neck may also split open and include a removable seam. The second shoulder may also be equipped with a similar removable seam. A shoulder may also be equipped with a removable seam extending along a top side of the shoulder. Additionally, both a top and bottom portion of the seamed sleeve may include a removable seam.

A plurality of pockets may be formed along the removable seam and configured to each retain an individual fastener of the plurality of fasteners. The plurality of fasteners may include buttons, hook and loop, ties, or any other known fastener. Preferably, the plurality of fasteners includes magnets, but it may also include a combination of different types of fasteners.

The reversible sling shirt may be configured to allow a patient to dress himself without assistance in one embodiment. In this embodiment, each one of the shoulders is solid and does not have removable seams. The removable seam extends along the body and bottom portion of a sleeve in a continuous removable seam.

Alternatively, the patient can elicit assistance with another embodiment of the reversible sling shirt. In this embodiment, there is an additional removable seam extending along a top portion of the sleeve, along the shoulder, and to the neck.

The invention may include one or more of the characteristics discussed above in various combinations, thus, allowing for a reduced time and labor to dress oneself. These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention and of the construction and operation of typical mechanisms provided with the present invention will become more readily apparent by referring to the exemplary and, therefore, non-limiting embodiments illustrated in the drawings accompanying and forming a part of this specification, wherein like reference numerals designate the same elements in the several views, and in which.

In describing the preferred embodiment of the invention which is illustrated in the attached drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected", "attached", or terms similar thereto are often used. However, they are not limited to direct connection but include connection through other elements where such connection is recognized as being equivalent by those skilled in the art.

DETAILED DESCRIPTION OF EMBODIMENTS

Figure 1:
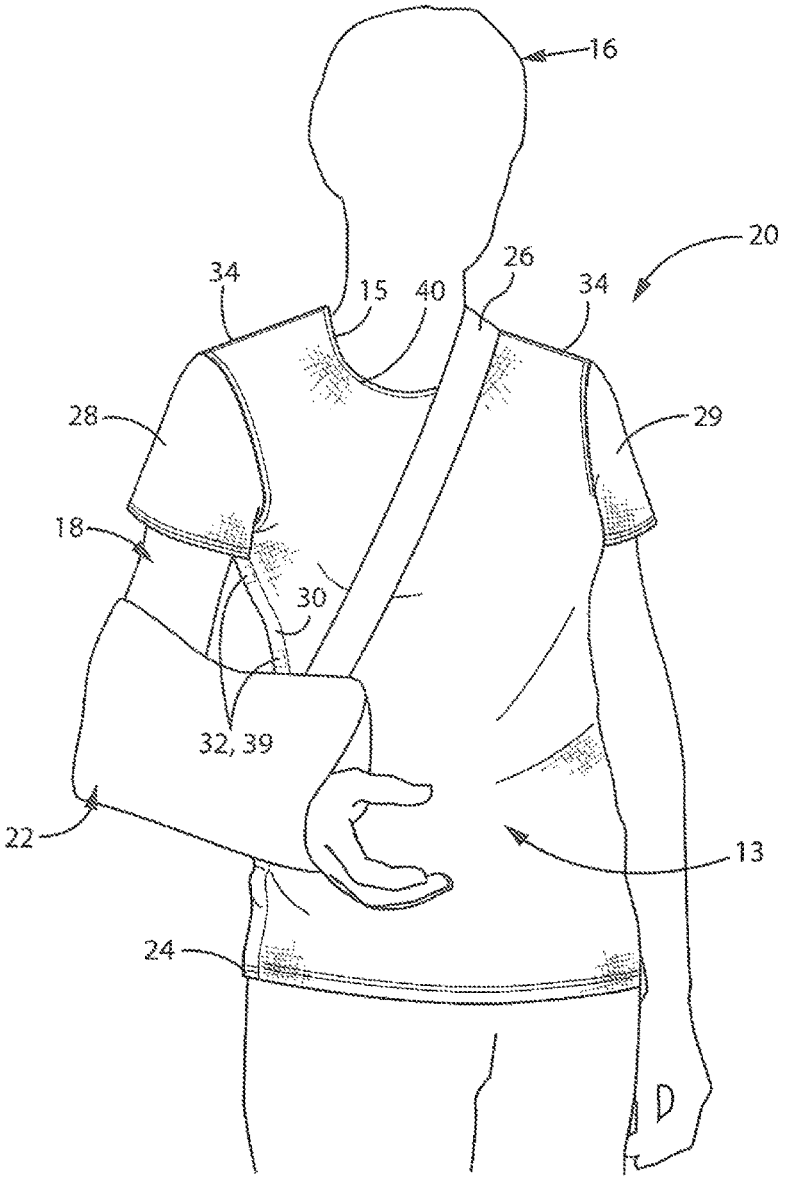
FIG. 1 is a front perspective view of an inventive reversible sling shirt with re-closable seams, that may be worn frontwards or backwards, and worn by an individual with an injured arm in an arm sling.

FIG. 1 shows a sling 26 that is typically worn by a patient 16 for an arm or shoulder injury. The sling 26 includes a pouch 22 configured to suspend the patient's arm 18 in traction. The arm 18 is commonly required to be maintained at an approximately 90 degree bend at the elbow in order to allow the muscles, bones, tendons, and ligaments to properly heal. Keeping the arm 18 in such a position can be particularly difficult when attempting to put on and take off clothing, e.g., a shirt.

Figure 2:
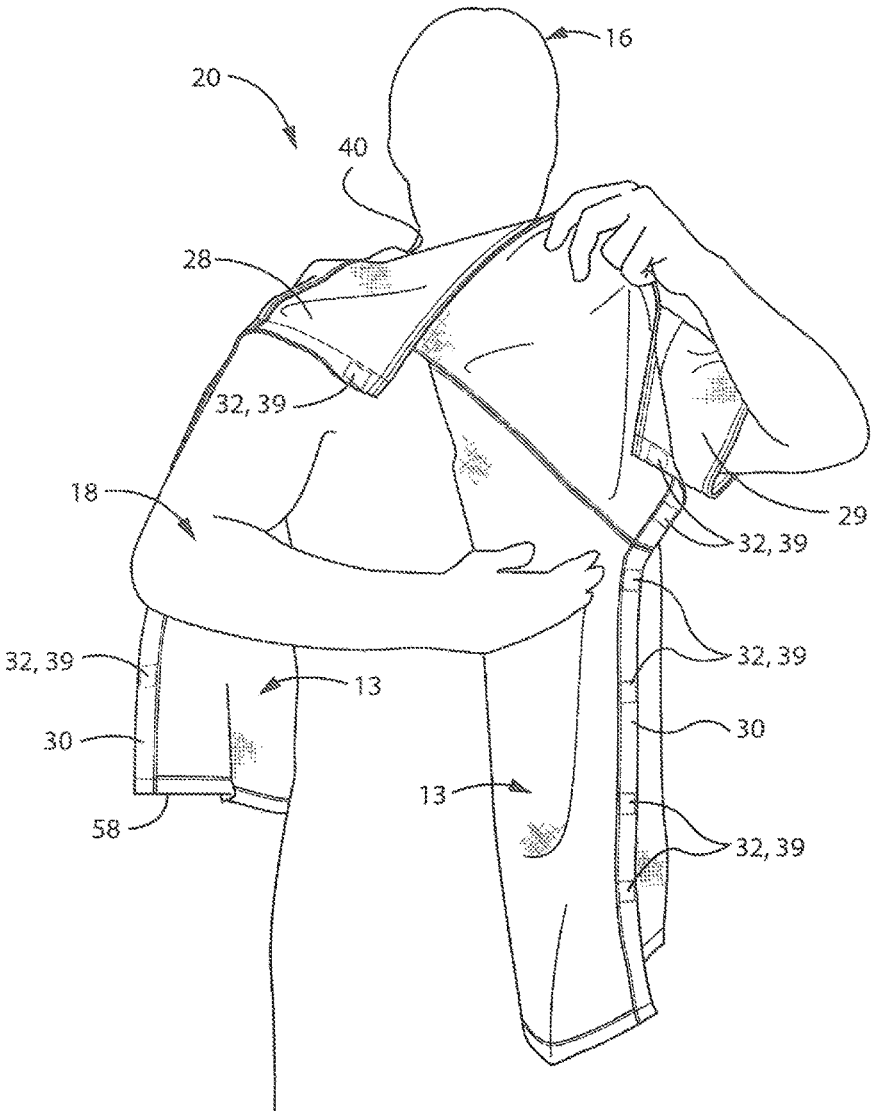
FIG. 2 is a front perspective view of the invention with opened fasteners, such as magnets or hook and loop material which partially disassemble the invention, with an individual in the process of putting the invention on himself/herself while the injured arm remains at an approximately 90 degree angle bend.

FIGS. 1-7 disclose one embodiment of the invention, a reversible sling shirt 20, which is configured to accommodate a patient with a sling 26. The reversible sling shirt 20 does not require assistance from another party for the patient 16 to dress and undress. As best shown in FIG. 2, the reversible sling shirt 20 may be split open along a removable seam 30 extending along the body 13 of the patient 16. The removable seam 30 runs the length of the reversible sling shirt 20 beginning at the waist area 24 and the underside of sleeve 28. As a result, the patient 16 may leave his arm 18 in a bent position of approximately 90 degrees and put the reversible sling shirt 20 on.

Referring to FIGS. 1 and 2, the reversible sling shirt 20 includes fasteners 32 that retain the removable seam 30 in a closed position. The fasteners 32 may include any known fastening device such as buttons, hook and loop, or other device. Preferably, magnets are located along the removable seam 30 and allow the patient to close and open the removable seam 30 with the use of only one hand. The magnetic fasteners 32 may also be concealed by sewing them into pockets 39 along the removable seam 30. The pockets 39 may take the form of a pouch with a magnet encased therein. Preferably, a single magnetic fastener 32 is encased in a pouch prior to attachment to the reversible sling shirt 20. The pouch may be in the form of a plastic sleeve with an individual magnet within or may be a strip of magnets extending along the removable seam 30. The pouch may also be made out of cloth or any known material. Simply placing the magnetic fastener 32 on one half of the removable seam 30 in proximity with the matching magnetic fastener 32 on the other half of the removable seam 30 forms an automatic bond between the two halves of the removable seam 30. When the patient 16 wishes to remove the reversible sling shirt 20, the fasteners 32 can be de-coupled as best shown in FIG. 2 all while the injured arm 18 is kept in the proper bent position. FIG. 2 also shows the removable seam 30 split in half due to the fasteners 32 being decoupled. By splitting the reversible sling shirt 20 open along the removable seam 30, it can be put on and taken off keeping the patient's arm 18 in a bent position and not requiring its use.

Figure 3:
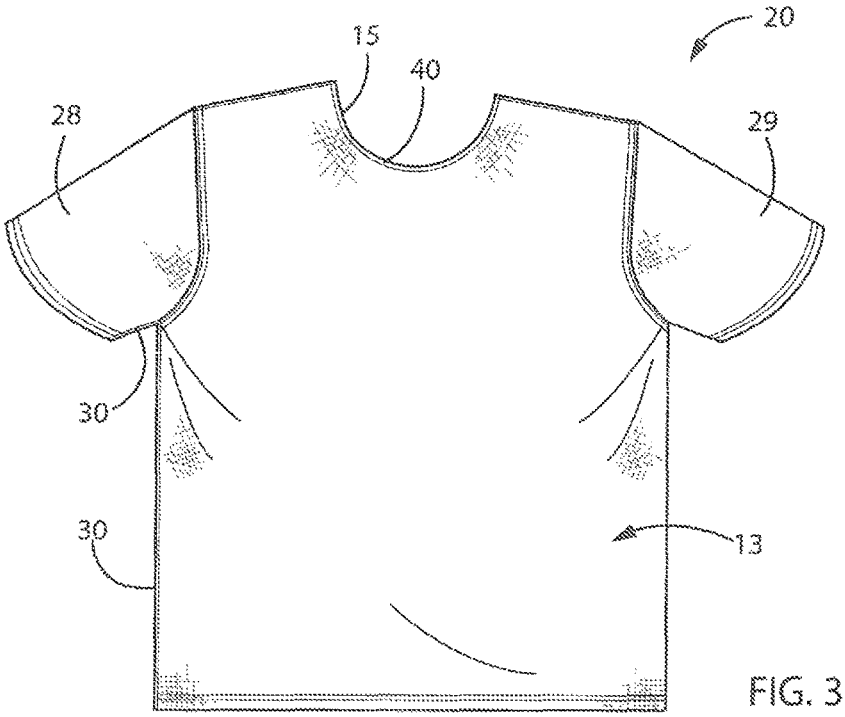
FIG. 3 is a front view of the invention fully assembled showing one shoulder area larger than the other shoulder area.
Figure 4:
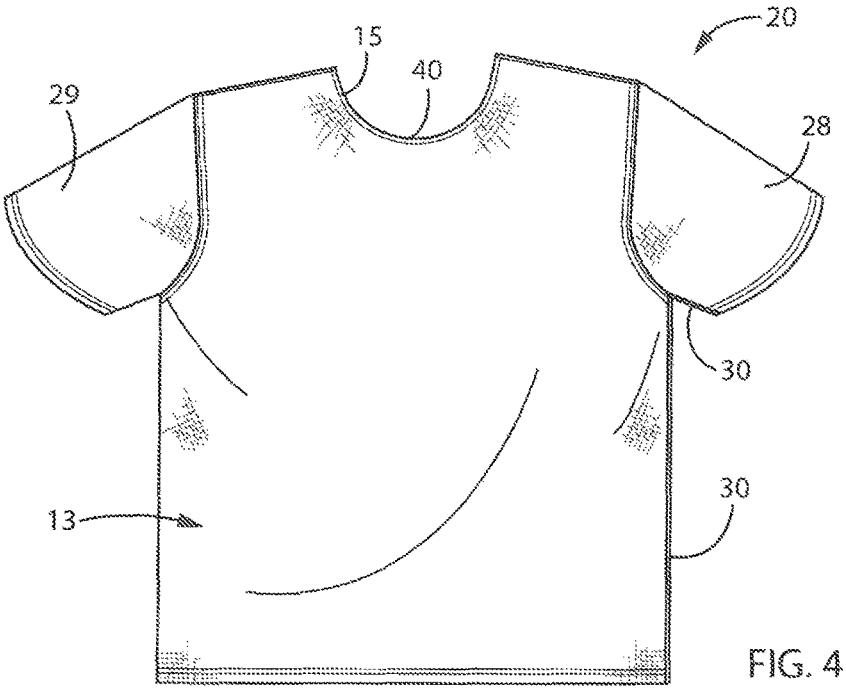
FIG. 4 is a rear view of the invention fully assembled showing one shoulder area larger than the other shoulder area and a visible removable seam along one side of the shirt.
Figure 5:
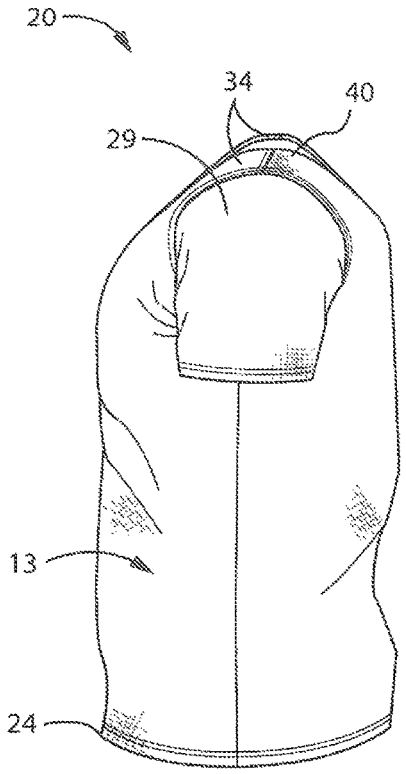
FIG. 5 is a right side view of the invention fully assembled showing the smaller side shoulder area.
Figure 6:
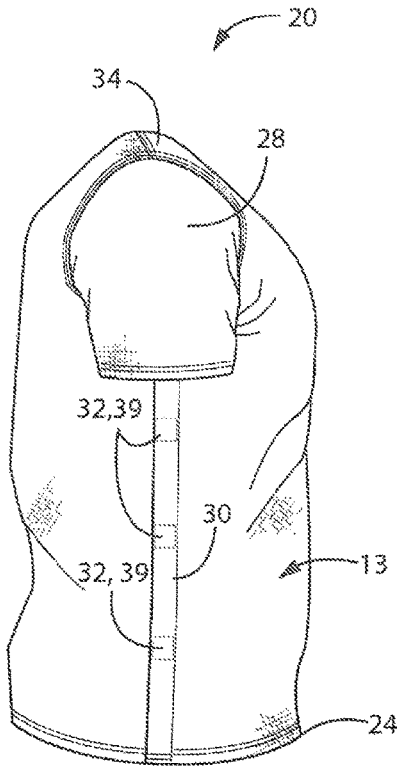
FIG. 6 is a left side view of the invention fully assembled showing the larger side shoulder area and suitable fasteners such as magnets or hook and loop material for the removable seam along a side length of the shirt.

Turning to FIGS. 3 and 4, the front and back side, respectively, of the reversible sling shirt 20 is shown. FIGS. 5 and 6 show the sides of the reversible sling shirt 20. The removable seam 30 is shown to run along a single side of the reversible sling shirt 20 and the bottom portion of a single sleeve 28. As the opposing solid sleeve 29 does not include a removable seam 30, the patient's uninjured arm can be placed through the solid sleeve 29 prior to fastening the fasteners 32 along the removable seam 30 closed.

The reversible sling shirt 20 may be configured to accommodate an injury to either arm of the patient 16. Should the opposing arm of the patient 16 be injured, the reversible sling shirt 20 may be worn backwards, thus accommodating for an injury to the opposite arm. Being able to wear the shirt frontwards or backwards provides reversibility. Conventional shirts typically include a neckline that has a slightly larger slope along the neckline of the front side of the shirt. This typically makes it uncomfortable or awkward to wear the shirt backwards. Having a different neck line along the front and back of the shirt also requires a healthcare provider to purchase two separate shirts, one for a left arm injury and one for a right arm injury. The reversibility of the shirt thus minimizes the expense in purchasing the garment as well as reducing storage space that is required. The reversible sling shirt 20 therefore has a similar neck line along both the front and the back of the shirt, as is shown in FIGS. 3 and 4. The shoulder on the removable seam 30 side is slightly higher than the shoulder by the solid sleeve 29. This is done to provide more fabric and room for the injured arm. This added room provides space for bandages, ice packs, heat packs, or the like beneath the shirt.

Figure 7:
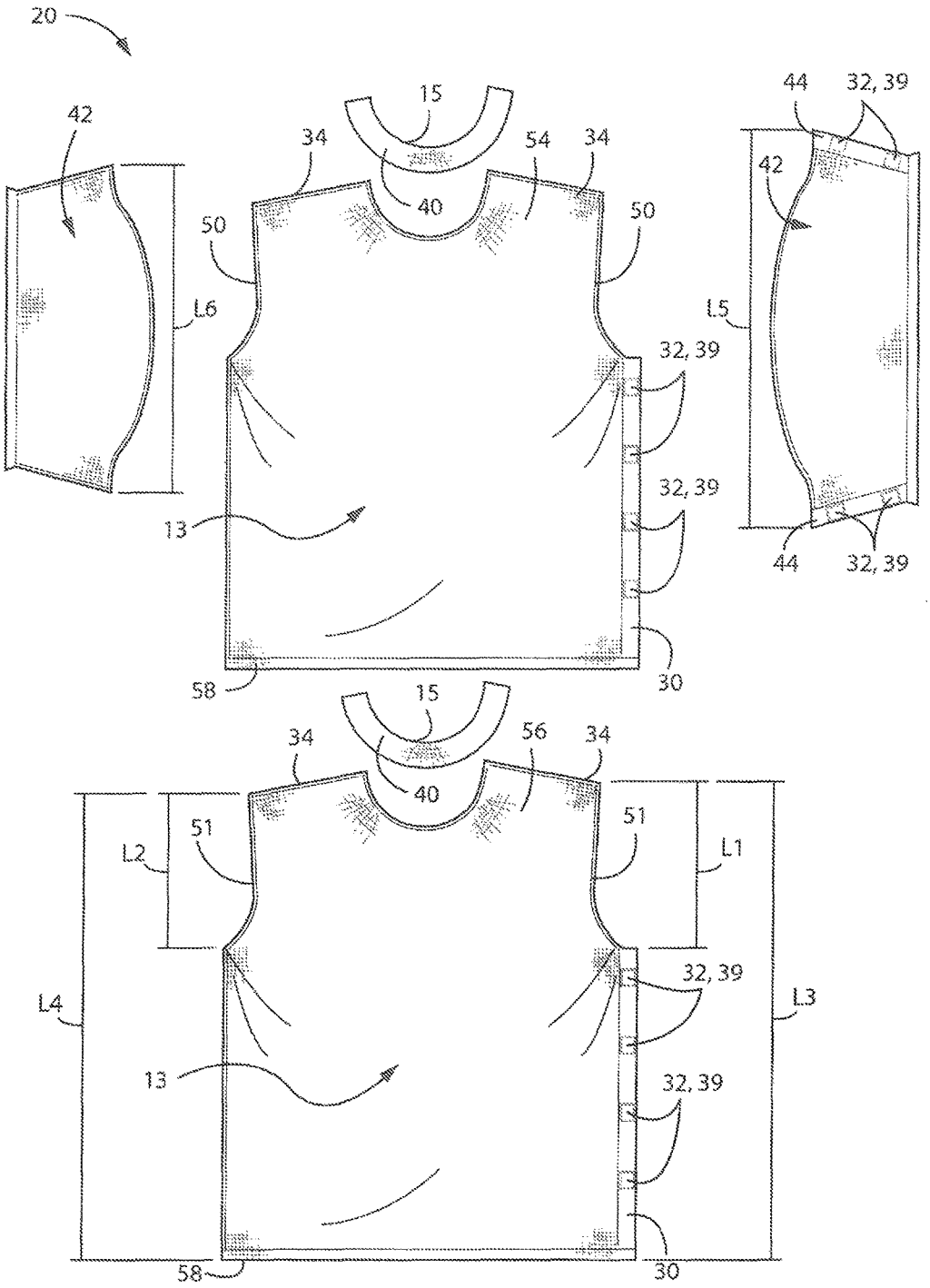
FIG. 7 is an exploded view of the invention showing the components of the shirt and the removable seams and fasteners.

Manufacture of the reversible sling shirt 20 may be performed in any known conventional manner. FIG. 7 indicates individual sections of fabric that may be used to assemble the reversible sling shirt 20. The front portion 54 of the reversible sling shirt 20 may be attached with adhesive, stitching, or the like to the rear portion 56 leaving the bottom 58 and sleeve holes 51 open. The removable seam 30 may be left open to allow a user to attach and detach the fasteners 32 to one another. Preferably one sleeve 42 attaches to a removable seam 50 on the front portion 54 and rear portion 56. The sleeve 42 may include fasteners 32 with a removable seam 44. The other sleeve 42 may attach to the opposing sleeve hole and not include fasteners 32 or a removable seam 44. Alternatively, each sleeve may include a removable seam 44 and both sides of the reversible sling shirt 20 may include a removable seam 30 with fasteners 32. The neck 40 may be attached to both the front portion 54 and rear portion 56 forming a solid unbroken circumference 15 at the top of the body 13 between the shoulders 34.

As shown in FIG. 7, a distance L1 between the shoulder 34 coupled to the sleeve 42 with a removable seam 44, otherwise referred to as the seamed sleeve 28, and the armpit 59 is greater than a distance L2 between the shoulder 34 coupled to the sleeve 42 without a removable seam 44, otherwise referred to as the solid sleeve 29, and the armpit 59. Similarly, a distance L3 between the shoulder 34 coupled to the seamed sleeve 28 and the bottom 58 of the shirt 20 is greater than a distance L4 between the shoulder 34 coupled to the solid sleeve 29 and the bottom 58 of the shirt 20. In other words, the shoulder 34 coupled to the seamed sleeve 28 is higher than the shoulder 34 coupled to the solid sleeve 29. Further, in order to accommodate L1 being greater than L2, the length L5 of the seamed sleeve 28 is greater than the length L6 of the solid sleeve 29. For example, but not to limit the invention, L5 may be 2.5 inches greater than L6.

Figure 8:
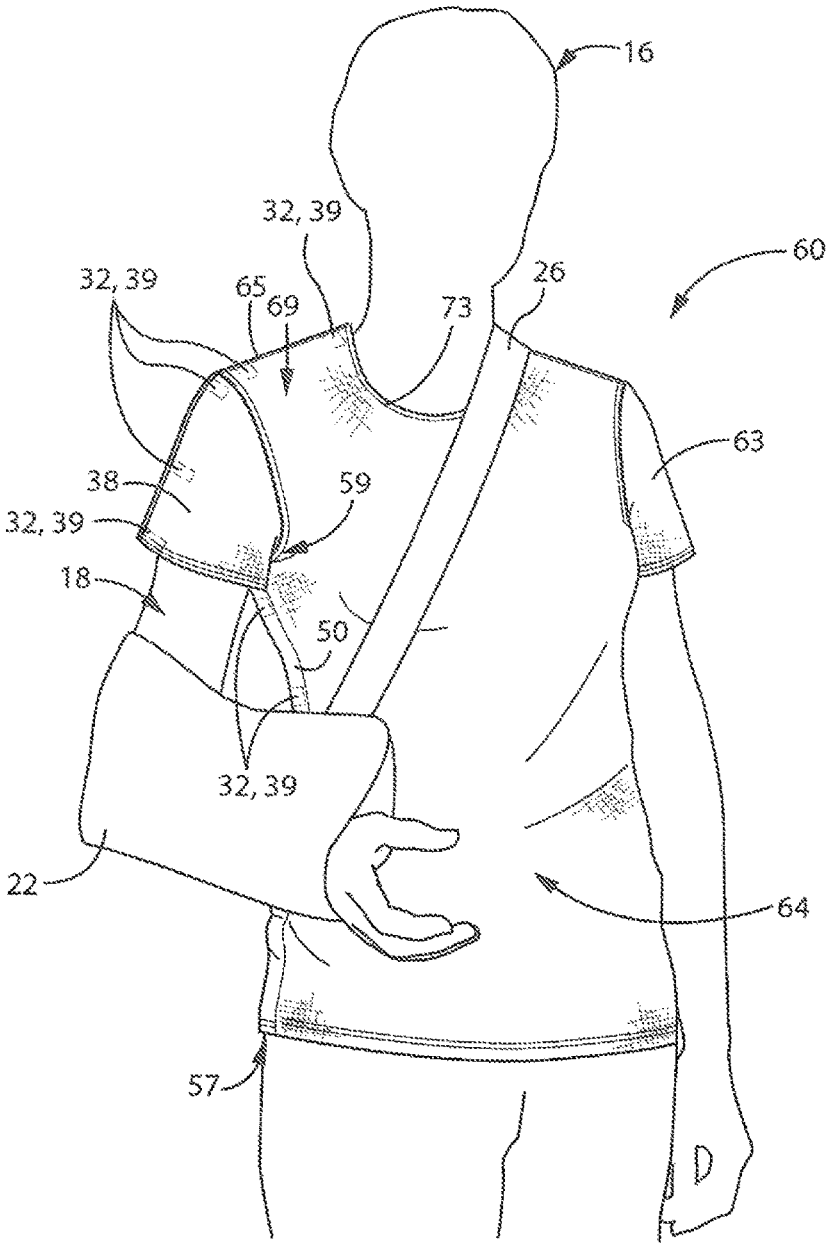
FIG. 8 is a front perspective view of another embodiment of the reversible sling shirt with removable seams worn by an individual with an injured arm in a sling.

FIG. 8 shows an alternative embodiment of the invention with an assisted reversible sling shirt 60. In this embodiment, the removable seam 50 extends along an entire side of the assisted reversible sling shirt 60. Another removable seam 65 begins on the shoulder 69 and runs along the top and bottom of the seamed sleeve 38. The removable seam 50 also runs along arm pit 59 and the side of the body 64 and terminates at the bottom 57 of the assisted reversible sling shirt 60. Similar to the previously-discussed embodiment, fasteners 32 allow the assisted reversible sling shin 60 to be removed and put on without movement of the injured arm 18 in the sling 26. As a result, the pouch 22 is able to maintain the injured arm 18 bent in the proper angle while the assisted reversible sling shirt 60 is put on, removed, and worn. Essentially, the assisted reversible sling shirt 60 is the same as the reversible sling shirt 20, but includes the added removable seams 65 and 50 along the seamed sleeve 38 and shoulder 69.

Figure 9:
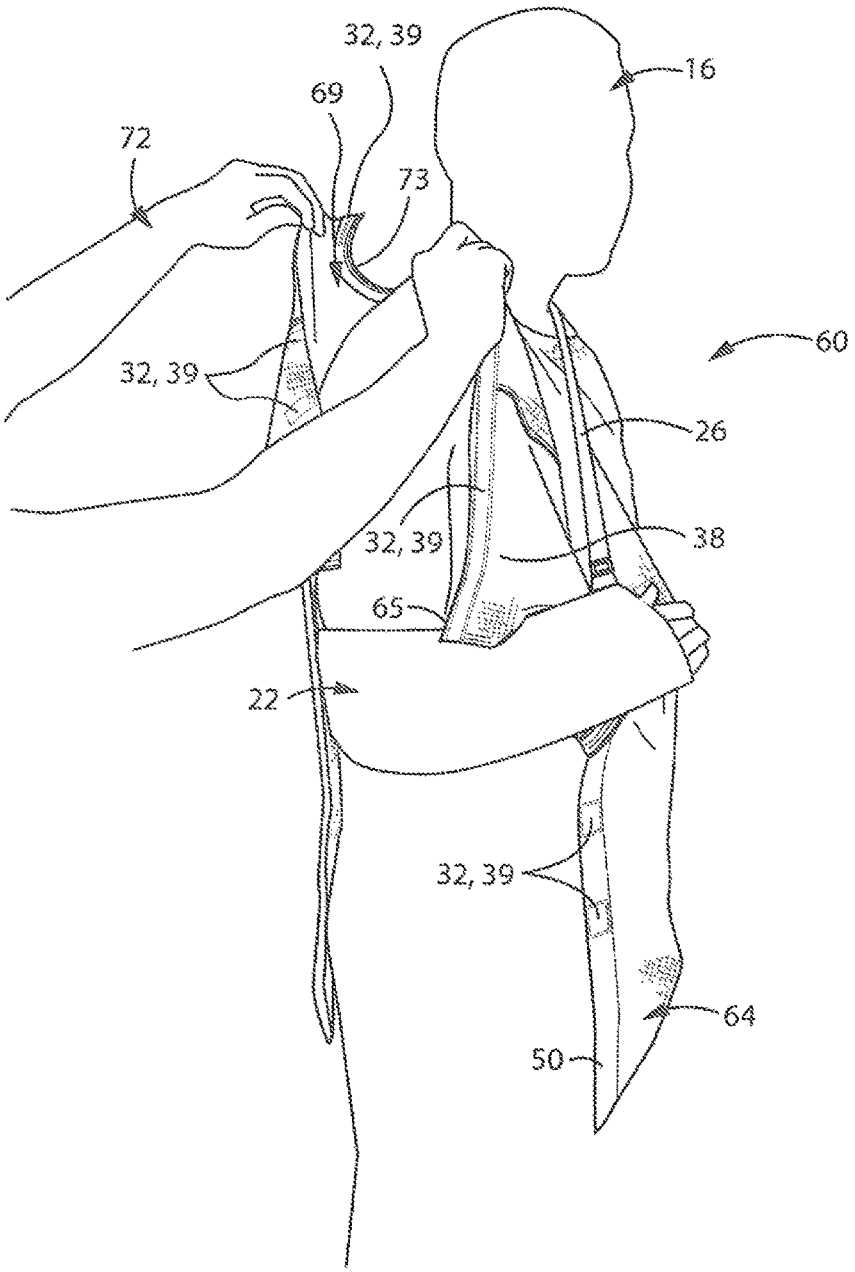
FIG. 9 is a front perspective view of the invention with opened fasteners, such as magnets or hook and loop material, which partially disassemble the invention, showing an individual in the process of putting the invention on with assistance while the injured arm remains suspended in a sling of similar device.
Figure 10:
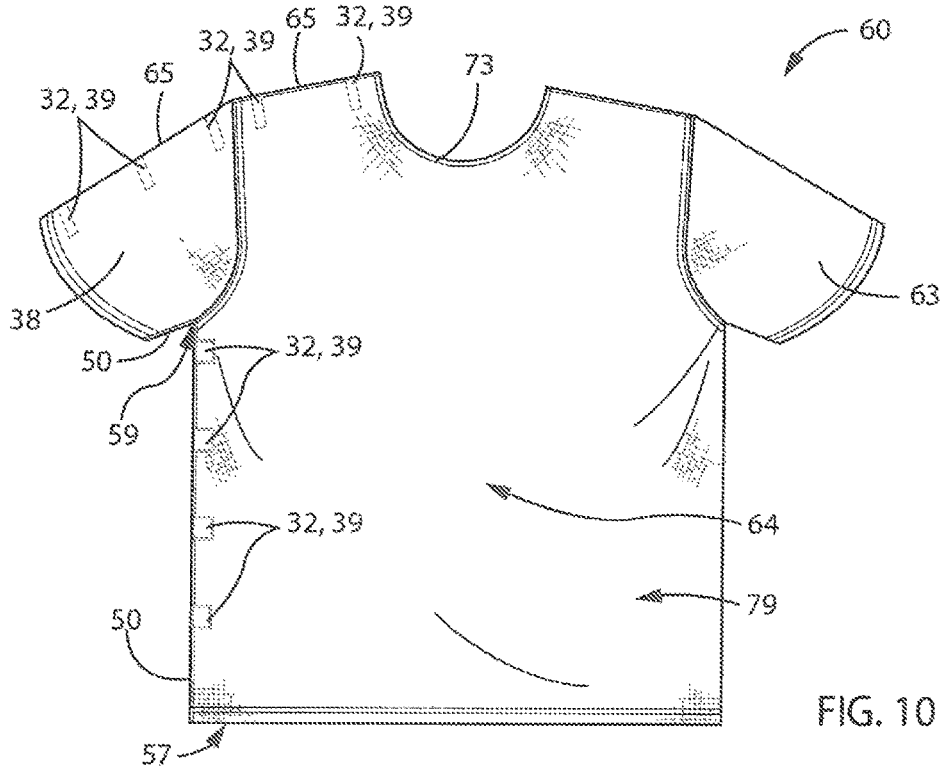
FIG. 10 is a front view of the invention fully assembled showing a side shoulder area larger than the other side shoulder area.
Figure 11:
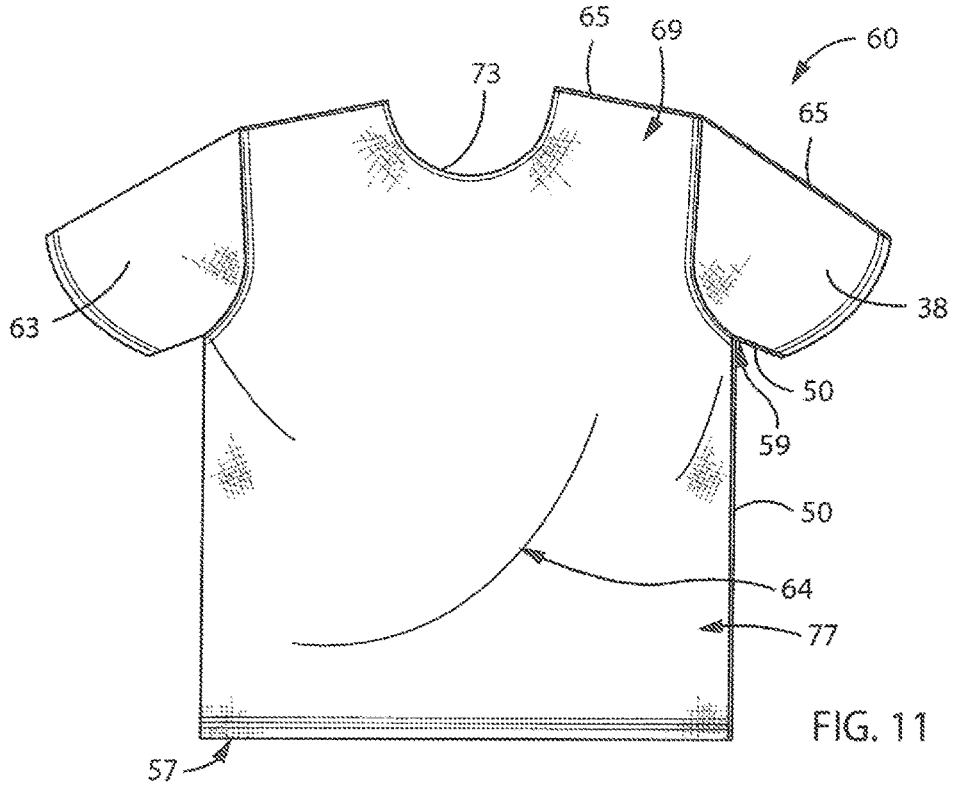
FIG. 11 is a rear view of the invention fully assembled showing a shoulder area on one side larger than the shoulder area on the other side and a visible re-closable seam along a side of the shirt and shoulder.
Figure 12:
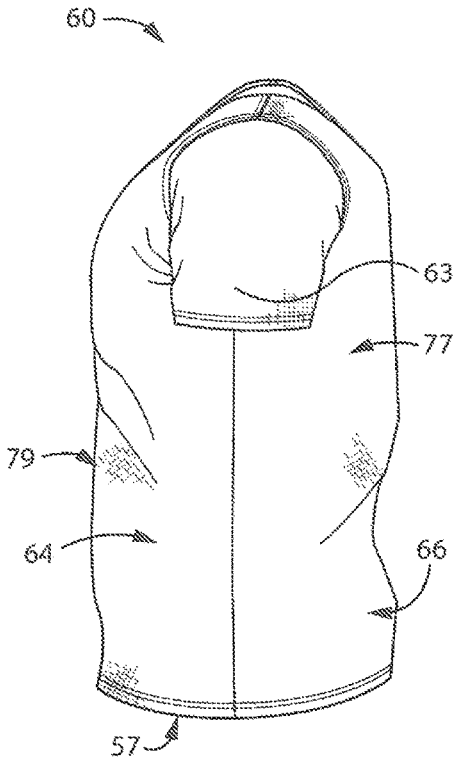
FIG. 12 is a right side view of the invention fully assembled showing the smaller shoulder area.
Figure 13:
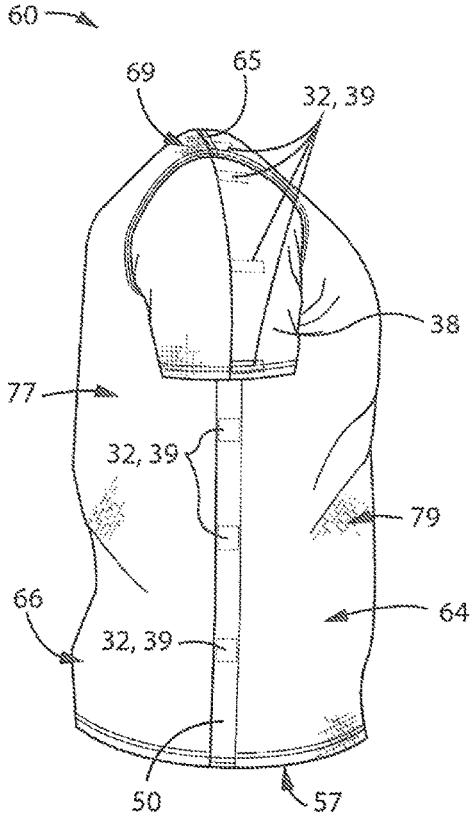
FIG. 13 is a left side view of the invention fully assembled showing the larger shoulder area and the removable seam and suitable fasteners such as magnets or hook and loop material for the removable side seam along a side of the shirt and shoulder.

As shown in FIG. 9, the assisted reversible sling shirt 60 requires assistance from a helper 72 in order for the patient 16 to put the assisted reversible sling shirt 60 on and to take it off. The injured arm 18 is kept bent at the proper angle with the use of the sling 26 and pouch 22. In order to properly wear the assisted reversible sling shirt 60, the patient 16 simply passes his uninjured arm 18 through a closed sleeve 63, pictured in FIGS. 10-13, which is opposite the seamed sleeve 38. FIG. 10 shows the front 79 of the assisted reversible sling shirt 60 while FIG. 11 shows the back 77 of the assisted reversible sling shirt 60. FIGS. 12 and 13 show left and right side views of the assisted reversible sling shirt 60. The seams 65 and 50 are best shown in FIGS. 10 and 13.

A removable seam 65 running down the top of the seamed sleeve 38 and along the top of the shoulder 69 may be opened by unfastening the fasteners 32. Preferably, the removable seam 65 is adjustable and includes adjustable fasteners. The adjustment allows the shirt to expand or contract along the removable seam 65 to make room for bandages, a shoulder strap or provide more clearance above any dressings. The adjustment preferably takes the form of hook and loop straps which allow the patient to easily set how tight the removable seam 65 is closed. Just as in the reversible sling shirt 20 shown in FIG. 1, the fasteners 32 may be similarly configured. Preferably, they are magnetic and sewn within a pouch in either individual pouches for each fastener, or a strip with multiple fasteners within the strip, just as described with respect to reversible sling shirt 20. Alternatively, hook and loop fasteners, buttons, or other non-ferrous fasteners may be used in either embodiment in order to prevent issues with magnetic resonance imaging. "MRI" machines or the like. The fasteners 32 may also run along the entirety of seams 65 and 50 or just in designated locations as depicted.

The additional removable seam 50 begins at the bottom 57 of the assisted reversible sling shirt 60 and runs along the body 64, along the arm pit 59 and along the bottom of seamed sleeve 38, as best shown in FIG. 10. Removable seam 65 runs from the neck 73 along the top of the shoulder 69 and along the top of seamed sleeve 38. Both removable seam 50 and removable seam 65 may be split open separating the front 79 and back 77 of the assisted reversible sling shirt 60. This is depicted in FIG. 9 which shows the helper 72 in the process of putting the neck 73, shoulder 69, and seamed sleeve 38 around the patient 16.

Figure 14:
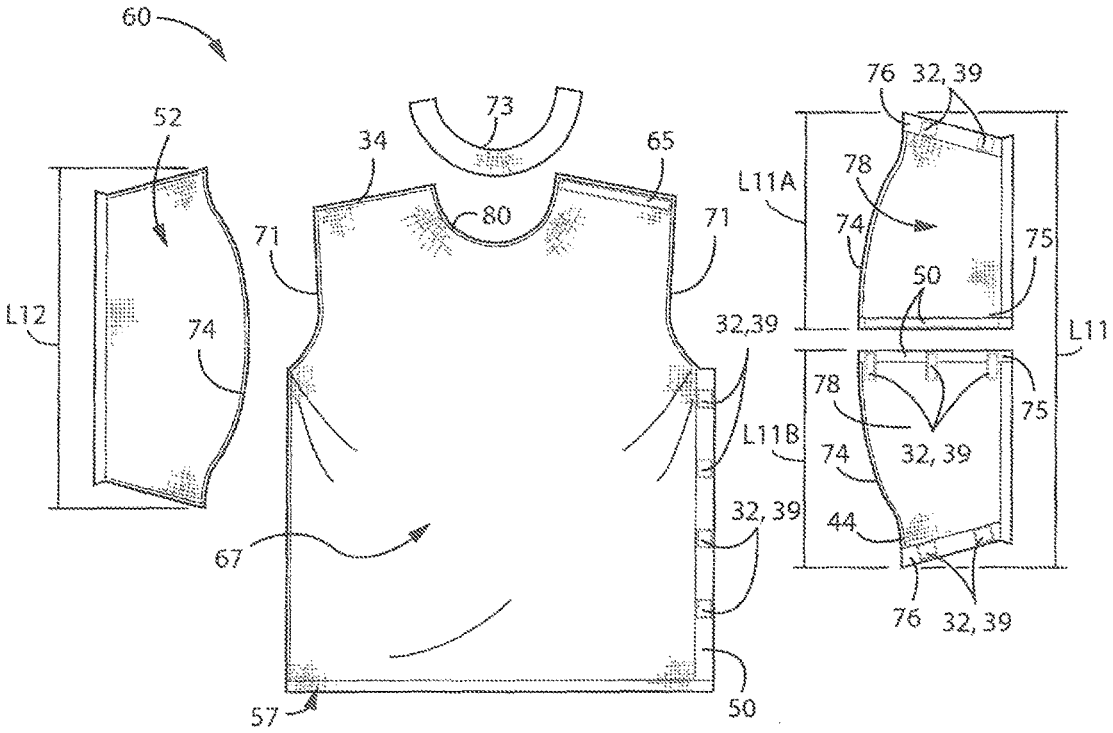
FIG. 14 is an exploded view of the invention showing the components of the shirt and the removable seams and fasteners.
Figure 14:
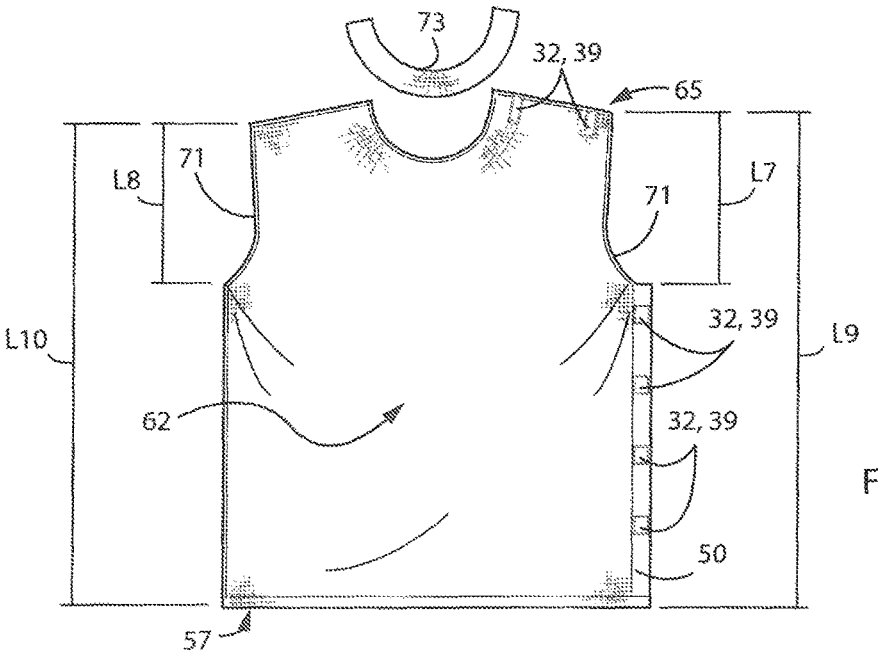

Referring now to FIG. 14, the solid fabric components of the assisted reversible sling shirt 60 are shown prior to attachment to one another. Preferably through sewing, but any other process may be used such as thermal bonding, adhesive, etc., each component may be attached. The front section 67 and the rear section 62 of the assisted reversible sling shirt 60 each has a sleeve seam 71 and a neck seam 80. The whole sleeve 52 is attached to the sleeve seam 71 along sleeve seam 74. This forms the closed sleeve 63 as depicted in FIG. 12. The opposite sleeve seam 71 on the front section 67 may be attached to the sleeve seam 74 on a sleeve half 78. The other sleeve half 78 may then be attached along the sleeve seam 71 on the rear section 62. Each sleeve half 78 includes fasteners 32 along a top portion 75 and bottom portion 76 of the sleeve, allowing the seamed sleeve 38 to be opened and closed as shown in FIG. 9.

When a patient is putting on the assisted reversible sling shirt 60, it may be passed underneath the sling 26 and also under the pouch 22 without movement of the injured arm 18 and without removal of the sling from the injured arm 18. As a result, the sling 26 may be kept in place and the injured arm 18 in traction while a patient puts on the assisted reversible sling shirt 60 and when it is removed as well.

Lastly, each half of the neck 73 may be attached to the respective front section 67 and rear section 62. Each half of the neck 73 is not fully joined to one another. Along removable seam 65, the assembled assisted reversible sling shirt 60 is left open allowing the patient 16 to put the assisted reversible sling shirt 60 on without needing to slip his head through the opening.

The removable seam 65 on the front section 67 and the removable seam 65 on the rear section 62 may be attached to one another using adjustable fasteners. The adjustment allows the shirt to expand or contract along the removable seam 65 to make room for bandages, a shoulder strap or provide more clearance above any dressings. The adjustment preferable takes the form of hook and loop straps, as shown in FIG. 14, which allow the patient to easily set how tight the removable seam 65 is closed. In one embodiment, the fasteners 32 may be replaced with a solid strip of hook and loop along the removable seam 65. Similarly, the removable seams 50 on the sleeve halves 78 are joined together with fasteners 32. Lastly, removable seam 50 on the front section 67 and rear section 62 may be joined with the fasteners 32.

The disclosed components of the assisted reversible sling shirt 60 shown in FIG. 14 and the reversible sling shirt 20 shown in FIG. 7 need not be formed as is shown. Any other manufacturing process may use a different material pattern than is shown as long as the seams held together with fasteners 32 remain able to be undone by hand with minimal effort. Both the assisted reversible sling shirt 60 and the reversible sling shirt 20 are constructed to allow them to be worn backwards, thus accommodating for an injury to the opposite arm. As previously discussed, being able to wear the shirt frontwards or backwards provides reversibility. Conventional shirts typically include a neckline that has a slightly larger slope along the neckline of the front side of the shirt. This typically makes it uncomfortable or awkward to wear the shirt backwards. Having a different neck line along the front and back of the shirt also requires a healthcare provider to purchase two separate shirts, one for a left arm injury and one for a right arm injury. The reversibility of the shirt thus minimizes the expense in purchasing the garment as well as reducing storage space that is required. The reversible sling shirts 20, 60 therefore have a similar neck line along both the front and the back of the shirt, as is shown in FIGS. 3, 4, and 14. The shoulder on the removable seam 30 side is slightly higher than the shoulder by the solid sleeve 29. This is done to provide more fabric and room for the injured arm. This added room provides space for bandages, ice packs, heat packs, or the like beneath the shirt.

As shown in FIG. 14, a distance L7 between the shoulder 34 coupled to the sleeve 78 with a removable seam 76, otherwise referred to as the seamed sleeve 38, and the armpit 59 is greater than a distance L2 between the shoulder 34 coupled to the sleeve 78 without a removable seam 76, otherwise referred to as the solid sleeve 63, and the armpit 59. Similarly, a distance L9 between the shoulder 34 coupled to the seamed sleeve 38 and the bottom 57 of the shirt 60 is greater than a distance L10 between the shoulder 34 coupled to the solid sleeve 63 and the bottom 57 of the shirt 60. In other words, the shoulder 34 coupled to the seamed sleeve 38 is higher than the shoulder 34 coupled to the solid sleeve 63. Further, in order to accommodate L7 being greater than L8, the length L11 of the seamed sleeve 38 is greater than the length L12 of the solid sleeve 63. For example, but not to limit the invention, L11 may be 2.5 inches greater than L12. In addition, lengths L7, L9, and L11 may be adjusted, as seams 65, 50 are adjustable. For example, L11 may be shortened or lengthened by changing the amount sleeve halves 78 having lengths 11A, 11B, respectively, overlap.

Although the best mode contemplated by the inventor of carrying out the present invention is disclosed above, practice of the present invention is not limited thereto. It will be manifest that various additions, modifications, and rearrangements of the features of the present invention may be made without deviating from the spirit and scope of the underlying inventive concept. Moreover, the individual components need not be formed in the disclosed shapes, or assembled in the disclosed configuration, but could be provided in virtually any shape and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications, and rearrangements. Expedient embodiments of the present invention are differentiated by the appended claims.

What is claimed is:

1. A reversible sling shirt for a patient with an injury comprising:

a body having a first and second shoulder, a waist area, and a bottom;

a sleeve and a seamed sleeve extending from the first and second shoulder, respectively;

a continuous, removable seam extending along the seamed sleeve and extending along the body to the waist area;

a plurality of fasteners along the removable seam configured to join one another and release from one another; and wherein a distance between the second shoulder to the bottom is greater than a distance from the first shoulder to the bottom.

2. The reversible sling shirt according to claim 1 further comprising an open neck between the first and second shoulders configured to remain a solid and continuous circumference, and wherein the neck is further configured to allow the patient to wear the shirt frontwards or backwards, providing reversibility.

3. The reversible sling shirt according to claim 1 further comprising a plurality of pockets formed along the removable seam configured to each retain an individual fastener of the plurality of fasteners.

4. The reversible sling shirt according to claim 3 wherein the plurality of fasteners includes magnets in pouches made of plastic.

5. The reversible sling shirt according to claim 1 wherein the plurality of fasteners includes hook and loop fasteners.

6. The reversible sling shirt according to claim 1 wherein the plurality of fasteners includes magnets.

7. The reversible sling shirt according to claim 1 further comprising an additional removable seam extending along a shoulder.

8. The reversible sling shirt according to claim 1 further comprising a removable seam extending along a top portion and a bottom portion of the seamed sleeve, running along an arm pit of the seamed sleeve.

9. The reversible sling shirt according to claim 7, further comprising an additional removable seam extending along the second shoulder.

10. The reversible sling shirt according to claim 1, further comprising:

each sleeve including a removable seam;

both sides of the reversible sling shirt including a removable seam with fasteners;

an open neck between the first and second shoulders configured to remain a solid and continuous circumference; and a pouch including a sling, configured to suspend the patient's arm in traction.

11. The reversible sling shirt according to claim 7, further comprising a neck joining the additional removable seam of the shoulder;

wherein the additional removable seam extends upwardly along a top portion of the sleeve, along the first shoulder and to the neck;

wherein the neck is configured to open at the additional removable seam upon detachment of the fasteners along the additional removable seam;

wherein the fasteners of the additional removable seam comprise a plurality of hook and loop fasteners; and wherein the continuous, removable seam fasteners are comprised of magnets in individual pouches made of plastic and sewn along the removable seam below an armpit.

12. A reversible sling shirt for a patient with an injury comprising:

a body having a first and second shoulder, a waist area configured to be worn about a patient, and a bottom;

a solid sleeve extending from the first shoulder of the body and configured to receive an arm of a patient;

a seamed sleeve extending from the second shoulder of the body and configured to receive an arm of a patient;

a plurality of plastic pockets along the seamed sleeve and configured to each enclose a magnetic fastener;

wherein the magnetic fasteners each within the respective pocket are configured to engage one another and reversibly close the seamed sleeve; and wherein a distance between the second shoulder and the bottom is greater than a distance between the first shoulder and the bottom.

13. The reversible sling shirt according to claim 12 further comprising a removable seam extending along one of the first and second shoulders.

14. The reversible sling shirt according to claim 13 further comprising a neck joining the shoulder seam, wherein the neck is configured to open at the shoulder seam upon detachment of the fasteners along the shoulder seam, so that a patient may put on the reversible sling shirt without needing to slip their head through the neck.

15. The reversible sling shirt according to claim 12 further comprising:

a removable seam extending along a top portion and a bottom portion of the seamed sleeve;

a shoulder with a shoulder seam adjacent the seamed sleeve;

a plurality of pockets along the shoulder seam and the removable seam; and wherein each one of the plurality of pockets contains a magnetic fastener, wherein the magnetic fasteners, each within a respective pocket, are configured to engage one another and reversibly close the shoulder seam and removable seam.

16. The reversible sling shirt according to claim 13, further comprising an additional removable seam extending along the second shoulder.

17. The reversible sling shirt according to claim 13, further comprising an open neck between the first and second shoulders configured to remain a solid and continuous circumference.

* * * * *